United States Patent [19]

LaRocca et al.

[11] Patent Number: 4,807,795

[45] Date of Patent: Feb. 28, 1989

[54] METHOD OF MAKING A BIMETALLIC SHAPED-CHARGE LINER

[75] Inventors: Edward W. LaRocca, Placentia; Robert Strike, Pomona, both of Calif.

[73] Assignee: General Dynamics Pomona Division, Pomona, Calif.

[21] Appl. No.: 931,238

[22] Filed: Nov. 14, 1986

Related U.S. Application Data

[63] Continuation of Ser. No. 751,830, Jul. 5, 1985, abandoned.

[51] Int. Cl.[4] ..... B23K 20/08

[52] U.S. Cl. ..... 228/107; 228/231; 72/83; 29/421.2

[58] Field of Search ..... 228/107, 231; 29/421 E; 72/83, 100

[56] References Cited

U.S. PATENT DOCUMENTS

| | | | |
|---|---|---|---|
| 3,024,938 | 3/1962 | Watter | 228/231 |
| 3,109,400 | 11/1963 | Paulton | 72/83 |
| 3,137,937 | 6/1964 | Cowon | 29/486 |
| 3,224,368 | 12/1965 | House | 102/24 |
| 3,237,559 | 3/1966 | Auberlinder | 102/24 |
| 3,300,836 | 1/1967 | Slater et al. | 228/231 |
| 3,583,062 | 6/1971 | Sharpe et al. | 29/470.1 |
| 3,789,760 | 2/1974 | Griffith | 102/24 HC |
| 3,842,485 | 10/1974 | Bement | 29/470.1 |
| 3,868,762 | 3/1975 | Nilsson | 29/470.1 |
| 3,969,917 | 7/1986 | Waterfall | 72/83 |
| 4,333,597 | 6/1982 | Hardwick | 228/108 |
| 4,554,810 | 11/1985 | Jurus | 72/83 |

*Primary Examiner*—Nicholas P. Godici
*Assistant Examiner*—Karen Skillman
*Attorney, Agent, or Firm*—Neil F. Martin; Leo R. Carroll

[57] ABSTRACT

A bimetallic shaped-charge liner is formed by explosively bonding two metal disks and then shear-forming the bonded disks simultaneously into a conoidal shape over a mandrel. An exemplary method for manufacturing a ductile, bimetallic, shaped-charge liner comprises the steps of explosively bonding a plate of one metal to a plate of another metal; annealing the bonded plates; cuting forming blanks from the bonded, annealed plates; shear-forming the blanks with the light metal side outward into a conoidal shape over a mandrel; and then annealing the resulting conoid.

8 Claims, No Drawings

METHOD OF MAKING A BIMETALLIC SHAPED-CHARGE LINER

This application is a continuation of Ser. No. 751,830 filed July 5, 1985, now abandoned.

BACKGROUND OF THE INVENTION

1. Field of the Invention

This invention relates in general to improved shaped-charge devices and more specifically to an improved method for making a bimetallic shaped-charge liner of greater effectiveness.

2. Description of the Related Art

It is well known that the the penetrating power of an explosive charge can be enhanced by forming a cavity in the face of the charge. If the cavity is formed in a symmetrical manner about an axis, the cavity tends to direct the force of the explosion along the axis. A greater portion of the energy from the explosion can thus be directed in a specific direction at a specific target, such as for penetrating an armored vehicle. Although a wide variety of cavity configurations is available, a conical or a cup-shaped cavity is most commonly used.

The effectiveness of a shaped-charge is further enhanced by lining the cavity with an inert material such as, for example, metal or glass. Upon detonation of the explosive charge, a high velocity pencil-like jet with high kinetic energy is formed from the liner material and is projected along the axis of the liner. Because of its high velocity and high kinetic energy, this jet is capable of penetrating solid material. In munition applications, the shaped-charged device is thus used to destroy armored vehicles by penetration of the protective armor. A liner is generally formed of a dense, ductile material, such as copper, which has been shown to have good penetrating ability.

While high density metals, such as copper, are excellent penetrators, they have little or no capability for beyond-armor effect, so that a follow-through charge is often employed to increase the lethality of the munition.

One concept featuring this enhancement of lethality is the use of pyrophoric metals for incendiary effects either as a liner or in a position for following the jet. This typically means the use of aluminum, magnesium, and other less dense metals.

The pyrophoric metals proved unsatisfactory as liners because of their poor penetration ability, so consequently, it was proposed to use a double-layer liner having a precursor cone of dense metal, for its penetration ability, and a follow-through cone of light metal for its incendiary effects. However, tests have shown that any gap between the metal liners greatly reduces the effectiveness of the jet. A gap, even as thin as an oil film between the metals, appears to produce a dis-continuous jet of greatly reduced penetrability. Tests indicated that a metal-to-metal interface was necessary for a continuous, high-penetration jet. The object of the research then became to create a bimetallic cone with no discrete interface between the metals.

Many approaches to solving the interface problem were tried and were found to have disadvantages. Some of these disadvantages were particularly related to the specific function of creating a penetrating jet.

To produce the desired liner, the precision machining of two perfectly mating cones was considered. Precision machining has several drawbacks. It is extremely expensive and time consuming. Additionally, even with the most precise machining, it is difficult to avoid all interface gaps and difficult to avoid inclusion of contaminants which degrade the interface. Another concept was to shear-form the two metals simultaneously over the same mandrel, thereby producing a conical liner of two metals. However, because of the differences in the flow characteristics of the different metals and inadequate shear force propagation, separation of the liners occurs during the process. Producing the bimetallic liner by metal deposition is prohibitively expensive and time consuming. Diffusion bonding or brazing two similar metal cones generally produces an intermediate surface containing intermetallic compounds that are brittle and greatly diminish the effectiveness of a jet.

The idea then surfaced that, if the two metals could be physically joined with a strong enough bond to resist the shearing forces that cause separation during shear-forming, then it may still be possible to shear-form the two metals simultaneously. Several conventional methods, including brazing and diffusion bonding, to prebond the metal prior to shear-forming, were attempted. These methods are relatively expensive and time consuming. In addition, the heat treatment used in these processes creates a brittle intermetallic interface which cannot be easily removed. This brittle interface material prevents controlled liner collapse and jet formation.

Therefore, it is desirable to have a method of producing a functional bimetallic, shaped-charged liner. It is further desirable that the method of manufacture be economical.

SUMMARY OF THE INVENTION

This invention describes a method for producing a bimetallic conoid. The method consists of first explosively bonding two metal disks and then shear-forming the bonded disks into a conoidal shape simultaneously over a mandrel. An exemplary method for particularly manufacturing a bimetallic, shape-charge liner consists of the steps of explosively bonding a plate of a light metal to a plate of a heavy metal; annealing the bonded plates; cutting circular forming blanks from the bonded, annealed plates; shear-forming the blanks with the light metal side outward into a conoidal shape over a mandrel; and annealing the resulting conoid. The resulting bimetallic, shape-charged liner is ductile, and the method used is very fast and economical. Other features and attendant advantages of the invention will become more apparent upon a reading of the following detailed description.

DETAILED DESCRIPTION OF THE INVENTION

In its simplest form, the method of manufacturing bimetallic conoids according to the principles of the present invention consists of first explosively bonding two metal disks and then shear-forming the bonded disks into a conoidal shape simultaneously over a mandrel. An exemplary method for particularly manufacturing a bimetallic, shaped-charge liner consists of the steps of explosively bonding a plate of a light metal to a plate of a heavy metal; annealing the bonded plates; cutting circular forming blanks from the bonded, annealed plates; shear-forming the blanks, with the light metal side outward, into a conoidal shape over a mandrel; so that the light metal resides on the external side of the resulting conoid and annealing the resulting conoid.

Methods of explosively bonding metals together are explained in U.S. Pat. No. 3,137,937 of George R. Cowhan et al incorporated herein by reference. Other patents and reference materials are available which describe variations and subtleties in explosive bonding methods. Essentially, in the explosive bonding process, two metal sheets are explosively driven together at a velocity near the sonic velocity of the metals, i.e., the velocity of the shock wave which forms when a stress which is applied just exceeds the elastic limit for unidimensional compression of the particular metal or metallic system involved.

The heavy metal plate comprises material, such as, but not limited to, copper or tungsten, which is known in the art to form a good penetrator material for shaped-charge liners. Such materials form a high density penetrator which is capable of imparting a large amount of kinetic energy to a target surface and effect penetration. When the liner collapses onto itself under the extremely high pressures exerted by the shaped-charge explosion, these materials form a long, thin, continuous, pencil like penetrator directed along the central axis of the charge liner.

An appropriate light metal for use in the present invention comprises materials such as, but not limited to, aluminum, or magnesium, which are known in the art as satisfactory pyrophoric materials, The pyrophoric material forms an incendiary layer which ignites shortly after penetration to generate an intense heat source causing a great deal of damage.

A metal plate comprising the heavy, good penetrator material, and a plate of metal comprising the light, pyrophoric material are bonded together to form a bimetallic plate structure from which the final shaped-charge liner is formed.

It is desirable to bond these two materials together, as previously discussed, in such a manner that they are capable of being manufactured into a charge liner having good penetration qualities and high damage capacity. This requires that any interface between the materials provide a high quality, continuous interface so that the materials flow together under the extreme pressures they experience during explosive compression. This causes the metals in a bimetallic liner to form a single directed penetrator as desired.

If the interface or joint between the metallic layers is too brittle, or has impurities, debris, gaps or other discontinuities, then the two metals will tend to separate under the extreme explosive forces at detonation of the shaped charge. In this later case, the two liners do not operate as a uniform penetrator jet of material traveling along the central axis of the charge liner as desired. Instead, the materials interact unevenly and form discontinuous jets or a jet having an angular direction with respect to the charge liner axis greatly reducing the overall effectiveness.

Once the plates are explosively bonded together they are formed into shaped-charge liners or conoids with the pyrophoric material positioned on the exterior of the conoid which will be placed adjacent the shaped-charge explosive material.

A conical, bimetal, shaped-charged liner of approximately 4 inches in diameter was formed according the the method of the present invention by explosively bonding a plate of copper of 0.125 inches in thickness to a similar sheet of aluminum. The bonded plates were then annealed to assure ductility. Circles of material (forming blanks) of approximately 4 inches in diameter were cut from the bimetallic plates. The forming blank disk was shear-formed over a mandrel with the copper side facing the mandrel. The final wall thickness of the cone measured 0.064 inches and was approximately equally divided between copper and aluminum.

Upon examination of bimetallic liners formed in this manner it was observed that the high pressures of detonation drove the metals together under explosive force so rapidly that the formation of intermetallic compounds was restricted, that is the pressure bond from explosive bonding does not heat the effected zone and there is no appreciable fusion with its resulting brittleness. A properly bonded interface is remarkably free of oxides, dirt, and oil. The metal should be relatively free of surface impurities before bonding. If the surfaces are unclean, usually cleaning of the surfaces with a mild abrasive followed by flushing with a solvent is adequate to remove any impurities which would impair adhesion or result in brittle areas. However, the exacting and elaborate cleaning and surface preparation required for other bonding methods is not necessary for the present process.

By using the explosive bonding method a single explosion can bond large sheets from which many liners can be formed. This proves to be more economical than separately explosively bonding the material for each liner. Also, explosively bonding large sheets of material allows a single manufacturing process with parallel process control for making liners of various sizes.

The mandrel is shaped to form the inside surface of the liner. The mandrel must be conducive to the shear forming operation and is generally cone-shaped. A numerically controlled precision shear-forming operation can form the liner in a single pass. Excess material may be trimmed off the bottom of the cone. This process does not require finish machining of the liner for accurate wall thickness and liner angle.

It can be seen that this method provides a very effective and efficient method of producing a bimetallic, shape-charged liner. Although a particular method of the invention has been described, modifications and changes will become apparent to those skilled in the art, and it is intended to cover in the appended claims such modifications and changes as come within the true spirit and scope of the invention. Thus, the exemplary method described herein is to be interpreted as illustrative and not in any limiting sense.

Having described our invention, we now claim:

1. A method of forming a bimetallic conoid for use in shaped-charge munitions having a penetration layer and an incendiary layer comprising the steps of:

explosively bonding a first metal sheet comprising a pyrophoric metal material to a second metal sheet comprising a metal having a greater density than said pyrophoric metal so as to form a bimetallic sheet having a continuous metal to metal interface joint between said first and second metal sheets without forming substantially any intermetallic compounds or discontinuities along said interface joint;

separating at least one generally circular preform plate from said bimetallic sheet having an incendiary layer corresponding to said pyrophoric metal and a penetration layer corresponding to said greater density metal; and shear-forming said preform plate using a conoidal mandrel, positioning said pyrophoric layer with respect to said mandrel so as to form a conoid having an outer incendiary layer.

2. The method of claim 1 wherein the step of shear-forming further comprises the step of controlling the motion of said conoidal mandrel and any associated forming members during said shear-forming step with a numerically controlled machine so as to produce a bimetallic conoid having a predetermined thickness, base diameter, and angle of taper, without further machining.

3. The method of claim 1 wherein said first and second sheets of metal comprise a sheet of metal on the order of 0.125 inches in thickness.

4. The method of claim 2 wherein said conoid comprises a bimetallic wall on the order of 0.064 inches in thickness.

5. The method of claim 1 wherein said second metal 2 comprises a metal chosen from the group of copper and tungsten.

6. The method of claim 1 wherein said first metal comprises a metal chosen from the group comprising aluminum and magnesium.

7. The method of claim 1 wherein said second metal comprises a metal chosen from the group comprising copper and tungsten.

8. The method of claim 1 wherein said first metal comprises a metal chosen from the group comprising aluminum and magnesium.

* * * * *